United States Patent [19]

Shapiro et al.

[11] 4,168,344

[45] Sep. 18, 1979

[54] VITREOUS ENAMEL MATERIAL FOR ELECTRICAL RESISTORS AND METHOD OF MAKING SUCH RESISTORS

[75] Inventors: Howard E. Shapiro, Philadelphia; Kenneth M. Merz, Gladwyne, both of Pa.

[73] Assignee: TRW Inc., Cleveland, Ohio

[21] Appl. No.: 836,574

[22] Filed: Sep. 26, 1977

Related U.S. Application Data

[63] Continuation-in-part of Ser. No. 633,398, Nov. 19, 1975, Pat. No. 4,057,777.

[51] Int. Cl.[2] ..... H01B 1/02

[52] U.S. Cl. ..... 428/427; 428/428; 428/433; 428/539; 428/328; 252/513; 427/101; 338/308

[58] Field of Search ..... 252/513; 428/427, 428, 428/433, 328; 427/101; 338/308, 309

[56] References Cited

U.S. PATENT DOCUMENTS

| | | | |
|---|---|---|---|
| 2,062,335 | 12/1936 | Scott | 313/317 |
| 3,484,284 | 12/1969 | Dates et al. | 252/513 X |
| 3,624,007 | 11/1971 | Meyer | 252/513 |
| 3,794,518 | 2/1974 | Howell | 252/513 X |

OTHER PUBLICATIONS

Kovar Alloy Handbook, Westinghouse Electric Corp., Blairsville, Pennsylvania, pp. 1–10.

Technical Data, Carpenter Vacumet Kovar (Nicoseal), Carpenter Technology, Carpenter Steel Division.

Product Guide, Review of Properties Alloys, Wilbur B. Driver Co., Newark, New Jersey.

Metals Handbook, Low-Expansion Alloys, American Society for Metals, Metals Park, Novelty, Ohio, vol. 1, 8th Ed., pp. 816–819.

*Primary Examiner*—Benjamin R. Padgett
*Assistant Examiner*—E. Suzanne Parr
*Attorney, Agent, or Firm*—Jacob Trachtman

[57] ABSTRACT

A material for a vitreous enamel electrical resistor includes a mixture of a glass frit and particles of nickel, iron and cobalt. The material is applied to a substrate and fired to melt the glass frit, and then cooled to form a layer of the glass with particles of an alloy of nickel, iron and cobalt embedded therein. The material provides a resistor having a high temperature coefficient of resistance and which can be self terminating.

20 Claims, 2 Drawing Figures

FIG. 1
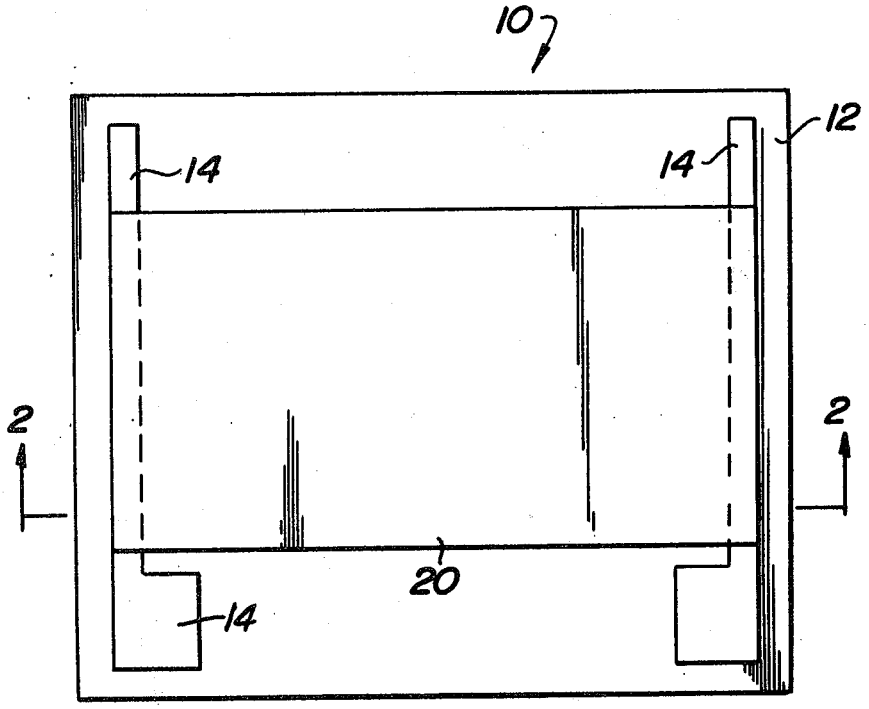
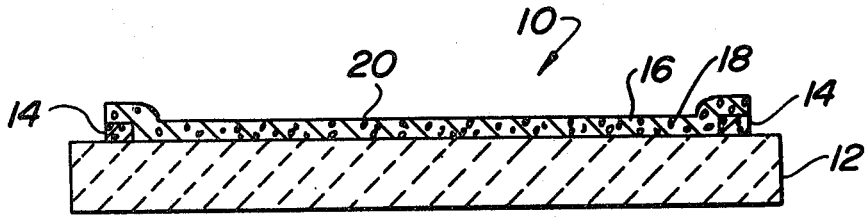
FIG. 2

VITREOUS ENAMEL MATERIAL FOR ELECTRICAL RESISTORS AND METHOD OF MAKING SUCH RESISTORS

This is a continuation-in-part of our copending application Ser. No. 633,398 filed Nov. 19, 1975, now U.S. Pat. No. 4,057,777 issued Nov. 8, 1977 and entitled TERMINATION FOR ELECTRICAL RESISTOR AND METHOD OF MAKING THE SAME.

The present invention relates to a material for an electrical resistor, and particularly to a vitreous enamel material for a vitreous enamel resistor having a high temperature coefficient of resistance and a method of making the same.

A type of resistance material which has come into use is the vitreous enamel resistance material which comprises a mixture of particles of a conductive material and a glass frit. To form a resistor, the vitreous enamel resistance material is applied to a substrate and fired to melt the glass frit. When cooled the resistor is a layer of glass having the conductive particles dispersed throughout the glass. Initially the conductive particles were of precious noble metals, such as gold, platinum, silver, etc., including mixtures and alloys of such noble metals, to provide a resistor having good electrical characteristics. To reduce the cost of the resistance materials, vitreous enamel resistance materials have been developed in which non-noble metals are used as the conductive particles. For example U.S. Pat. No. 3,394,087 to C.Y.D. Huang et al, issued July 23, 1968, entitled "Glass Bonded Resistor Compositions Containing Refractory Metal Nitrides and Refractory Metal" discloses the use of tantalum nitride and tantalum as the conductive particles, and U.S. Pat. No. 3,180,841 to R. M. Murphy et al, issued Apr. 27, 1965 entitled "Resistance Material and Resistor Made Therefrom" discloses the use of tungsten carbide and tungsten as the conductive particles.

Although for most uses, it is desirable to have resistors with low temperature coefficients of resistance so that the resistors are relatively stable with respect to changes in temperature, there are some uses for resistors which have a high temperature coefficient of resistance. For example, resistors having a high positive temperature coefficient of resistance are useful as temperature controls or to prevent run away conditions in an electrical circuit which could result in overheating, by providing a resistor whose resistance increases when heated.

Therefore, it is an object of the present invention to provide a novel material for use as an electrical resistor.

It is another object of the present invention to provide a novel vitreous enamel material for use as an electrical resistor.

It is still another object of the present invention to provide a vitreous enamel material for making resistors having a high positive temperature coefficient of resistance and the method of making such resistors.

It is a further object of the present invention to provide a vitreous enamel material for use in making an electrical resistor which can be self terminating and the method of making such resistors.

It is still further object of the present invention to provide a material for an electrical resistor which includes a mixture of particles of an alloy of nickel, iron and cobalt and a glass frit.

Other objects will appear hereinafter.

The invention accordingly comprises a composition of matter, the product formed therewith, and the method of making the product possessing the characteristics, properties and relation of constituents which will be exemplified in the composition hereinafter described, the scope of the invention being indicated in the claims.

For a fuller understanding of the nature and objects of the invention, reference should be had to the following detailed description taken in connection with the accompanying drawing, in which:

FIG. 1 is a top plan view of an electrical resistor made with the material of the present invention; and FIG. 2 is a sectional view taken along line 2—2 of FIG. 1.

In general, the material of the present invention comprises a mixture of a vitreous glass frit and finely divided particles of an alloy of nickel, iron and cobalt. Elemental particles of nickel, iron and cobalt can also be used. The alloy particles are present in the mixture in the amount of 10% to 95% by volume. However, 20% to 60% by volume of the alloy particles is preferred. The alloy particles include nickel in the amount of 12% to 75% by weight, iron in the amount of 5% to 60% by weight, and cobalt in the amount of 5% to 70% by weight.

The glass frit used in the material of the present invention may be of any well known composition which has a melting temperature below that of the alloy of nickel, iron and cobalt. The glass frits most preferably used are the borosilicate frits, such as bismuth, cadmium, barium, calcium or other alkaline earth borosilicate frits. The preparation of such glass frits is well known and consists, for example, in melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtain a frit of substantially uniform size.

The alloy of nickel, iron and cobalt may be any commercially available alloy of nickel, iron and cobalt of the desired ratio of the metals. The alloy may also be formed by mixing together particles of nickel, iron and cobalt and firing the mixture at about 1400° C. When elemental particles of nickel, iron and cobalt are used, alloying of them is achieved during the firing of the material.

To make the material of the present invention, glass frit and −325 mesh particles of the alloy (or its elemental particles), in the desired proportion, are thoroughly mixed together, such as by ball milling in an organic medium, such as butyl carbitol acetate. The preferred particle size of the milled batch measured with a Fisher sub-sieve sizer is 0.9 to 1.1. The milled batch is then drained from the ball mill and the mixture is dried at a temperature of 100° C. to 110° C. for 8 to 12 hours to remove any remaining organic medium. The mixture of the glass frit and alloy particles are then mixed with a vehicle suitable for the desired manner of applying the material to form a resistor. For example, the mixture can be mixed with a Reusche squeegee medium for applying the material by screen printing.

To form an electrical resistor, the material of the present invention is applied to the surface of a substrate, the substrate may be a body of any material which will withstand the firing temperature of the material. The substrate is generally a body of an insulating material, such as ceramic, glass, porcelain, steatite, barium titanate, alumina or the like. The material may be applied on the substrate by brushing, dipping, spraying or screen stencil application. The material is then dried to remove any liquid vehicle, such as by heating at 150° C. for 5 to 15 minutes. If desired, the material on the substrate can then be heated to about 350° C. in a non-oxidizing or nitrogen atmosphere for about a half an hour to remove any organic binder in the material. The coated substrate is then fired in a conventional furnace to a temperature at which the glass frit becomes molten. The material is preferably fired in an inert atmosphere, such as nitrogen. Although the firing temperature depends on the melting temperature of the glass frit used, for borosilicate glass frits, the material may be fired at a temperature of between 850° C. and 1200° C. for a period of one half of an hour to one hour. When the coated substrate is cooled, there is provided a resistor having on the substrate a layer of glass with the particles of the alloy of nickel, iron and cobalt embedded in and dispersed throughout the glass.

Referring to the drawing, there is shown a resistor, generally designated as 10, which includes a flat substrate 12 of a ceramic material. On a surface of the substrate 12 are two spaced terminations 14 of a conductive material. On the surface of the substrate 12 between the terminations 14 is a resistance material layer 20 of the material of the present invention comprising a layer of glass 16 having particles 18 of an alloy of nickel, iron and cobalt. The resistance material layer 20 overlies each of the terminations 14 so as to make contact therewith. Although the resistance material layer 20 is shown as extending over the terminations 14, the terminations 14 can extend over the ends of the resistance material layer 20.

The following examples are given to illustrate certain preferred details of the invention, it being understood that the details of the examples are not to be taken as in any way limiting the invention thereto.

EXAMPLE I

A material was made by mixing together 10% by volume of a mixture of nickel, iron and cobalt particles and 90% by volume of a glass frit. The mixture of metal particles contained 35% by weight nickel, 30% by weight iron and 35% by weight cobalt. The glass frit was of the composition by weight 52% bariumoxide (BaO), 20% boron oxide ($B_2O_3$), 20% silica ($SiO_2$), 4% aluminum oxide ($Al_2O_3$) and 4% titanium oxide ($TiO_2$). The mixture was thoroughly mixed together in a ball mill with butyl carbitol acetate. The mixture was then dried at a temperature of 100° C. to 110° C. and then blended with Reusche screening vehicle.

Batches of resistors were made by silk screen printing the material on flat substrates of alumina. The coated substrates were then dried at 150° C. for about 10 minutes and then fired in a conveyor furnace at 1000° C. in a nitrogen atmosphere over a ½ hour cycle. The resistance values of the resistors were measured. Some of the resistors were tested for temperature coefficient of resistance and some of the resistors were subjected to a short time no load test. The no load test is a heat stability test during which the resistors are subjected to heat of 275° C. in an oven for short periods up to 3 hours. The resistors which were measured for temperature coefficient of resistance had the following average characteristics:

| | |
|---|---|
| Resistance (ohms/square) | 3.3K |
| Temperature Coeff. of Resistance (PPM/°C.) | |
| 275° C. | −1735 |
| 200° C. | −2144 |
| 125° C. | −2626 |

The resistors which were subjected to the no load test had the following average characteristics:

| | |
|---|---|
| Resistance (ohms/square) | 2K |
| 275° C. No Load (change in resistance) | |
| 0.3 hours | 4.8% |
| 3.0 hours | 9.3% |

EXAMPLE II

A material was made in the same manner as described in Example I, except that the material contained 20% by volume of the metal particles, and the mixture of metal particles contained 25% by weight nickel, 5% by weight iron and 70% by weight cobalt. Resistors were made from the material in the same manner as described in Example I. The resistors which were tested for temperature coefficient of resistance had the following characteristics:

| | |
|---|---|
| Resistance (ohms/square) | 0.12 |
| Temperature Coeff. of Resistance (PPM/°C.) | |
| 275° C. | 4289 |
| 200° C. | 4076 |
| 125° C. | 3546 |

The resistors which were subjected to the no load test had the following characteristics:

| | |
|---|---|
| Resistance (ohms/square) | 0.24 |
| 275° C. No Load (change in resistance) | |
| 0.3 hours | 0.3% |
| 3.0 hours | 0.9% |

EXAMPLE III

A material was made in the same manner as described in Example I, except that the material contained 25% by volume of the metal particles, and the mixture of metal particles contained by weight 75% nickel, 20% iron and 5% cobalt. Resistors were made from the material in the same manner as described in Example I. The resistors which were tested for temperature coefficient of resistance had the following average characteristics:

| | |
|---|---|
| Resistance (ohms/square) | 0.056 |
| Temperature Coeff. of Resistance (PPM/°C.) | |

-continued

| | |
|---|---|
| 275° C. | 4449 |
| 200° C. | 4366 |
| 125° C. | 3844 |

The resistors which were subjected to the no load test had the following characteristics:

| | |
|---|---|
| Resistance (ohms/square) | 0.086 |
| 275° C. No Load (change in resistance) | |
| 0.3 hours | −.7% |
| 1.0 hours | −.6% |
| 3.0 hours | −.4% |

EXAMPLE IV

A material was made in the same manner as described in Example I, except that the material contained 40% by volume of the metal particles, and the mixture of metal particles contained by weight 53% nickel, 32% iron and 15% cobalt. Resistors were made from the material in the same manner as described in Example I. The resistors which were tested for temperature coefficient of resistance had the following average characteristics:

| | |
|---|---|
| Resistance (ohms/square) | 0.07 |
| Temperature Coeff. of Resistance (PPM/°C.) | |
| 275° C. | 4525 |
| 200° C. | 4465 |
| 125° C. | 4003 |

The resistors which were subjected to the no load test had the following average characteristics:

| | |
|---|---|
| Resistance (ohms/square) | 0.10 |
| 275° C. No Load (change in resistance) | |
| 0.3 hours | ±0.1% |
| 3.0 hours | 0.6% |

EXAMPLE V

A material was made in the same manner as described in Example I, except that the material contained 60% by volume of the metal particles, and the mixture of metal particles contained by weight 12% nickel, 23% iron and 65% cobalt. Resistors were made from the material in the same manner as described in Example I. The resistors which were tested for temperature coefficient of resistance had the following average characteristics:

| | |
|---|---|
| Resistance (ohms/square) | 0.024 |
| Temperature Coeff. of Resistance (PPM/°C.) | |
| 275° C. | 5785 |
| 200° C. | 5576 |
| 125° C. | 4798 |

The resistors which were subjected to the no load test had the following average characteristics:

| | |
|---|---|
| Resistance (ohms/square) | 0.34 |
| 275° C. No Load (change in resistance) | |
| 0.3 hours | −0.5% |
| 1.0 hours | −0.2% |
| 3.0 hours | ±0.2% |

EXAMPLE VI

A material was made in the same manner as described in Example I, except that the material contained 70% by volume of the metal particles, and the mixture of metal particles contained by weight 45% nickel, 15% iron and 40% cobalt. Resistors were made from the material in the same manner as described in Example I. The resistors which were tested for temperature coefficient of resistance had the following average characteristics:

| | |
|---|---|
| Resistance (ohms/square) | 0.015 |
| Temperature Coeff. of Resistance (PPM/°C.) | |
| 275° C. | 5226 |
| 200° C. | 5060 |
| 125° C. | 4475 |

The resistors which were subjected to the no load test had the following average characteristics:

| | |
|---|---|
| Resistance (ohms/square) | 0.022 |
| 275° C. No Load (change in resistance) | |
| 0.3 hours | ∓0.8% |
| 1.0 hours | −0.6% |
| 3.0 hours | 5.4% |

EXAMPLE VII

A material was made in the same manner as described in Example I, except that the material contained 80% by volume of the metal particles, and the mixture of metal particles contained by weight 50% nickel, 25% iron and 25% cobalt. Resistors were made from the material in the same manner as described in Example I. The resistors which were tested for temperature coefficient of resistance had the following average characteristics:

| | |
|---|---|
| Resistance (ohms/square) | 0.02 |
| Temperature Coeff. of Resistance (PPM/°C.) | |
| 275° C. | 5602 |
| 200° C. | 5461 |
| 125° C. | 4811 |

The resistors which were subjected to the no load test had the following average characteristics:

| | |
|---|---|
| Resistance (ohms/square) | 0.03 |
| 275° C. No Load (change in resistance) | |
| 0.3 hours | ±0.4% |
| 3.0 hours | 1.6% |

EXAMPLE VIII

A material was made in the same manner as described in Example I, except that the material contained 90% by volume of the metal particles, and the mixture of metal particles contained by weight 60% nickel, 10% iron and 30% cobalt. The material was made into resistors in the manner described in Example I. The resistors which were tested for temperature coefficient of resistance had the following average characteristics:

| | |
|---|---|
| Resistance (ohms/square) | 0.02 |
| Temperature Coeff. of Resistance (PPM/°C.) | |
| 275° C. | 4847 |
| 200° C. | 4819 |
| 125° C. | 4216 |

The resistors which were subjected to the no load test had the following average characteristics:

| | |
|---|---|
| Resistance (ohms/square) | 0.03 |
| 275° C. No Load (change in resistance) | |
| 0.3 hours | 5.3% |
| 3.0 hours | 14% |

EXAMPLE IX

A material was made in the same manner as described in Example I, except that the material contained 95% by volume of the metal particles. The material was made into resistors in the same manner as described in Example I. The resistors which were tested for temperature coefficient of resistance had the following average characteristics:

| | |
|---|---|
| Resistance (ohms/square) | 0.03 |
| Temperature Coeff. of Resistance (PPM/°C.) | |
| 200° C. | 5563 |
| 125° C. | 4906 |

The resistors which were subjected to the no load test had the following average characteristics:

| | |
|---|---|
| Resistance (ohms/square) | 0.02 |
| 275°C. No Load (change in resistance) | |
| 0.3 hours | 1.8% |
| 3.0 hours | 13% |

EXAMPLE X

A material was made by mixing together 40% by volume of a mixture of nickel, iron and cobalt particles and 60% by volume of the glass frit described in Example I. The mixture contained by weight 53% nickel, 32% iron and 15% cobalt. The material was blended with a Reusche screening vehicle and made into resistors in the manner described in Example I. The resultant resistors had the following average characteristics:

| | |
|---|---|
| Resistance (ohms/square) | 0.06 |
| Temperature Coeff. of Resistance (PPM/°C.) | |
| 275° C. | 5440 |
| 200° C. | 5162 |
| 125° C. | 4637 |
| 275° C. No Load (change in resistance) | |
| 0.3 hours | 0.62% |
| 1.0 hours | 0.41% |
| 3.0 hours | 0.54% |

EXAMPLE XI

A material was made in the same manner as described in Example X, except that the mixture of metal particles included by weight 33% nickel, 60% iron and 7% cobalt. Resistors were made from the material in the same manner as described in Example I. The resultant resistors had the following average characteristics:

| | |
|---|---|
| Resistance (ohms/square) | 0.18 |
| Temperature Coeff. of Resistance (PPM/°C.) | |
| 275° C. | 2905 |
| 200° C. | 3072 |
| 125° C. | 3263 |
| 275° C. No Load (change in resistance) | |
| 0.3 hours | 0.50% |
| 1.0 hours | 0.18% |
| 3.0 hours | 0.30% |

EXAMPLE XII

A material was made in the same manner as described in Example X, except that the mixture of metal particles included by weight 29% nickel, 54% iron and 17% cobalt. Resistors were made from the material in the same manner as described in Example I. The resultant resistors had the following average characteristics:

| | |
|---|---|
| Resistance (ohms/square) | 0.13 |
| Temperature Coeff. of Resistance (PPM/°C.) | |
| 275° C. | 3927 |
| 200° C. | 4026 |
| 125° C. | 4218 |
| 275° C. No Load (change in resistance) | |
| 0.3 hours | 0.69% |
| 1.0 hours | 0.64% |
| 3.0 hours | 0.54% |

EXAMPLE XIII

A material was made in the same manner as described in Example X, except that the mixture of metal particles contained by weight 22% nickel, 38% iron and 40% cobalt. Resistors were made from the material in the same manner as described in Example I. The resultant resistors had the following average characteristics:

| | |
|---|---|
| Resistance (ohms/square) | 0.07 |
| Temperature Coeff. of Resistance (PPM/°C.) | |

-continued

| | |
|---|---|
| 275° C. | 5093 |
| 200° C. | 4971 |
| 125° C. | 4700 |
| 275° C. No Load (change in resistance) | |
| 0.3 hours | 0.81% |
| 1.0 hours | 0.56% |
| 3.0 hours | 0.33% |

EXAMPLE XIV

A material was made in the same manner as described in Example X, except that the mixture of metal particles contained by weight 20% nickel, 55% iron and 25% cobalt. Resistors were made from the material in the same manner as described in Example I. The resultant resistors had the following average characteristics:

| | |
|---|---|
| Resistance (ohms/square) | 0.07 |
| Temperature Coeff. of Resistance (PPM/°C.) | |
| 275° C. | 4493 |
| 200° C. | 4325 |
| 125° C. | 3741 |
| 275° C. No Load (change in resistance) | |
| 0.3 hours | ±0.50% |
| 1.0 hours | ∓0.52% |
| 3.0 hours | ∓0.77% |

EXAMPLE XV

A material was made in the same manner as described in Example XII, except that in place of the mixture of metal particles, particles of an alloy of the metals in the same proportion by weight 29% nickel, 54% iron and 17% cobalt of −325 mesh were used. Resistors were made from the material in the same manner as described in Example I. The resultant resistors had the following average characteristics:

| | |
|---|---|
| Resistance (ohms/square) | 0.25 |
| Temperature Coeff. of Resistance (PPM/°C.) | |
| 275° C. | 3877 |
| 200° C. | 4038 |
| 150° C. | 3919 |
| 275° C. No Load (change in resistance) | |
| 0.3 hours | −0.1 |
| 1.0 hours | ±0.2 |
| 3.0 hours | ±0.2 |

EXAMPLE XVI

A material was made in the same manner as described in Example XV, except that the material contained 50% by volume of the alloy particles. Resistors were made from the material in the same manner as described in Example I. The resultant resistors had the following average characteristics:

| | |
|---|---|
| Resistance (ohms/square) | 0.06 |
| Temperature Coeff. of Resistance (PPM/°C.) | |
| 275° C. | 4105 |
| 200° C. | 4000 |

-continued

| | |
|---|---|
| 125° C. | 3850 |
| 275° C. No Load (change in resistance) | |
| 0.3 hours | ∓0.4 |
| 1.0 hours | ±0.5 |
| 3.0 hours | ∓0.5 |

Thus, it can be seen from the above Examples that the vitreous enamel material of the present invention forms resistors having a high temperature coefficient of resistance. Example I through IX, XV and XVI show the effects of varying the amount of the alloy in the material, and the Examples X through XV show the effects of varying the amounts of the various metals in the alloy. In the material of the present invention, the cobalt also effects the coefficient of expansion of the material so as to permit the making of a material which has a coefficient of expansion similar to that of the substrate on which the material is coated. Also, it has been found that the materials containing a larger amount of the alloy particles up to about 80% by volume, form a resistance layer which can be self terminating.

The present invention may be embodied in other specific forms without departing from the spirit or essential attributes thereof, and accordingly, reference should be made to the appending claims rather than to the foregoing specification as indicating the scope of the invention.

What we claim is:

1. A material comprising a mixture of metal particles consisting of nickel, iron and cobalt and a glass frit, in which the mixture contains 20% to 60% by volume of the metal particles, and the metal particles contain by weight 12% to 75% nickel, 5% to 60% iron and 5% to 70% cobalt.

2. A material in accordance with claim 1 in which the metal particles are an alloy of the nickel, iron and cobalt.

3. A material in accordance with claim 1 in which the glass frit is a borosilicate glass.

4. An electrical resistor having a high temperature coefficient of resistance comprising a substrate and a resistance material on said substrate, said resistance material comprising a layer of glass having particles of an alloy consisting of nickel, iron and cobalt dispersed throughout the glass, said resistance material including 10% to 95% by volume of the alloy particles, and the alloy particles contain by weight 12% to 75% nickel, 5% to 60% iron, and 5% to 70% cobalt.

5. An electrical resistor in accordance with claim 4 in which the resistance material contains 20% to 60% by volume of the alloy particles.

6. An electrical resistor in accordance with claim 5 in which the glass is a borosilicate glass.

7. An electrical resistor in accordance with claim 4 in which the glass is a borosilicate glass.

8. A method of making an electrical resistor having a high temperature coefficient of resistance wherein a vitreous enamel material is applied to a substrate comprising the steps of preparing a vitreous enamel material comprising a glass frit and finely divided particles consisting of nickel, iron and cobalt, the particles providing 10% to 95% by volume of the material, and the particles containing by weight 12% to 75% nickel, 5% to 60% iron and 5% to 70% cobalt, applying a layer of the material to an insulating substrate, firing the coated substrate in a non oxidizing atmosphere at a temperature sufficient to form an adherent vitreous composition, and cooling the coated substrate to form a resistance material thereon having a glass matrix with conductive particles dispersed therein.

9. The method of claim 8 in which the vitreous enamel material is fired in nitrogen at a temperature between 850° C. and 1200° C.

10. The method of claim 9 in which the material contains, 20% to 60% by volume of the alloy particles.

11. The method of claim 8 in which the metal particles of the material are an alloy of nickel, iron and cobalt.

12. The method of claim 11 in which the material contains 20% to 60% by volume of the alloy particles.

13. The method of claim 8 in which the material contains 20% to 60% by volume of the alloy particles.

14. An electrical resistor having a high temperature coefficient of resistance comprising a substrate and a resistance material layer on said substrate, said resistance material layer being formed by preparing a vitreous enamel material comprising a glass frit and finely divided particles of nickel, iron and cobalt, with the particles providing 10% to 95% by volume of the material, and the particles containing by weight 12% to 75% nickel, 5% to 60% iron and 5% to 70% cobalt, applying a layer of the material to the substrate, firing the coated substrate in a non-oxidizing atmosphere at a temperature sufficient to form an adherent vitreous composition, and cooling the coated substrate to form the resistance material layer having a glass matrix with the metal particles dispersed therein.

15. The electrical resistor in accordance with claim 14 in which the metal particles of the resistance material are an alloy of nickel, iron and cobalt.

16. The electrical resistor in accordance with claim 15 in which the material contains 20% to 60% by volume of the alloy particles.

17. The electrical resistor in accordance with claim 14 in which the material contains 20% to 60% by volume of the metal particles.

18. The electrical resistor in accordance with claim 14 in which the vitreous enamel material is fired in nitrogen at a temperature between 850° C. and 1200° C.

19. The electrical resistor in accordance with claim 18 in which the material contains 20% to 60% by volume of the alloy particles.

20. The electrical resistor in accordance with claim 14 in which the material contains 20% to 60% by volume of the alloy particles.

* * * * *